US005673453A

United States Patent [19]

Huang

[11] Patent Number: 5,673,453

[45] Date of Patent: Oct. 7, 1997

[54] TOOTHBRUSH WITH DETACHABLE BRISTLE HEAD CAPABLE OF CHANGING ORIENTATION RELATIVE TO ITS HANDLE

[76] Inventor: Raymond Huang, No. 493, Ta-Yu Rd.., Tao-Yuan City, Taiwan

[21] Appl. No.: 730,457

[22] Filed: Oct. 15, 1996

[51] Int. Cl.[6] ..... A46B 9/04

[52] U.S. Cl. ..... 15/167.1; 15/144.1; 15/145; 15/172; 15/176.1; 15/176.4

[58] Field of Search ..... 15/144.1, 145, 15/167.1, 172, 176.1, 176.4–176.6; 403/3, 4, 354, 361

[56] References Cited

U.S. PATENT DOCUMENTS

| | | | |
|---|---|---|---|
| 2,185,867 | 1/1940 | Pensky | 15/172 X |
| 5,165,135 | 11/1992 | Su | 15/172 X |
| 5,394,584 | 3/1995 | Breitschmid | 15/176.6 X |

FOREIGN PATENT DOCUMENTS

| | | | |
|---|---|---|---|
| 649074 | 8/1928 | France | 15/172 |
| 2014278 | 10/1971 | Germany | 15/176.1 |

*Primary Examiner*—Mark Spisich

*Attorney, Agent, or Firm*—Harness, Dickey & Pierce, P.L.C.

[57] ABSTRACT

A toothbrush includes a bristle head and an elongated handle. The bristle head has an elongated shaft extending therefrom, and an engagement rib formed axially on an external surface of the shaft. An upper portion of the handle has an axial hole which forms an opening in a top end of the upper portion, a radial hole that extends radially therethrough in communication with the axial hole and that forms a mouth at a circumferential wall of the upper portion, and an axial slit that extends along the circumferential wall from the opening to the mouth such that the axial hole is also opened laterally through the axial slit. The handle is made of a material which enables a snug-fit connection of the shaft in the axial hole or the radial hole via the opening or the mouth, when the shaft and the engagement rib on the bristle head are inserted respectively into the axial hole and the axial slit in the handle, or into the radial hole and the axial slit in the handle.

2 Claims, 5 Drawing Sheets

TOOTHBRUSH WITH DETACHABLE BRISTLE HEAD CAPABLE OF CHANGING ORIENTATION RELATIVE TO ITS HANDLE

BACKGROUND OF THE INVENTION

1. Field of the Invention

The invention relates to a toothbrush, more particularly to a toothbrush which has a bristle head with a variable orientation relative to its handle so as to facilitate thorough cleansing of teeth and gum areas.

2. Description of the Related Art

Referring to FIGS. 1 and 2, a conventional toothbrush is shown to include a bristle head 11, an elongated handle 12, a resilient element 13, and a fastener. As illustrated, the bristle head 11 has a connecting portion 111 extending axially therefrom, a through hole 112 formed transversely through the connecting portion 111, and a transversely extending inner wall which defines the hole 112 and which is formed with two pairs of diametrically opposed engagement grooves 113. The handle 12 has an enlarged head 121 formed with a transversely extending fastener hole 123 and an axially extending recess 122 which is in communication with the fastener hole 123 and which is configured to receive the connecting portion 111 of the bristle head 11 in such a manner that the holes 112, 123 are aligned with each other. The fastener includes a tubular nut member 14 and a screw 15. The nut member 14 is inserted into the holes 112, 123 of the head 11 and the handle 12 and has four axially extending tongues 142 formed on an external surface thereof. The resilient element 13 is sleeved on the screw 15 prior to threading of the same into the threaded hole 141 in the nut member 14 in such a manner that the tongues 142 engage the grooves 113 partially, thereby preventing rotation of the bristle head 11 relative to the handle 12. Under such a condition, the resilient element 13 abuts against the nut member 14 so as to bias the screw 15 such that the nut member 14 and the screw 15 are movable limitedly within the holes 112, 123 upon pressing on the screw 15 so as to disengage the tongues 142 from the grooves 113, thereby permitting rotation of the bristle head 11 relative to the handle 12.

Some of the drawbacks resulting from the aforementioned conventional toothbrush are as follows:

(I) Several components are required to form the conventional toothbrush, thereby resulting in a higher manufacturing cost.

(II) During back and forth movement of the bristle head 11 when brushing teeth, the enlarged head 121 of the handle 12 may collide against the mouth, thereby resulting in injury to the user.

SUMMARY OF THE INVENTION

The object of this invention is to provide a toothbrush which is simple in construction so as to eliminate the aforementioned drawbacks and which includes a detachable bristle head, the orientation of which relative to the handle of the toothbrush is changeable so as to facilitate thorough cleansing of teeth and gum areas.

Accordingly, the toothbrush of this invention includes a bristle head and an elongated handle. The bristle head has an elongated shaft extending therefrom, and an engagement rib formed axially on an external surface of the shaft. An upper portion of the handle has an axial hole that forms an opening in a top end of the upper portion, a radial hole that extends radially through the upper portion and in communication with the axial hole and that forms a mouth at a circumferential wall of the upper portion, and an axial slit that extends along the circumferential wall from the opening to the mouth such that the axial hole is also opened laterally through the axial slit. The handle is made of a material which enables a snug-fit connection of the elongated shaft in the axial hole or the radial hole via the opening or the mouth, when the shaft and the engagement rib on the bristle head are inserted respectively into the axial hole and the axial slit in the handle, or into the radial hole and the axial slit in the handle.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 4:
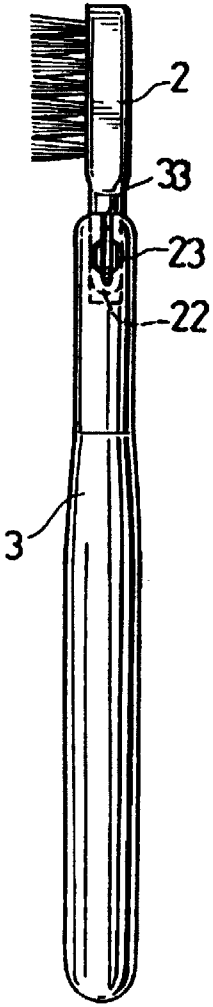
FIG. 4 is a side view of the toothbrush of this invention.
Figure 3:
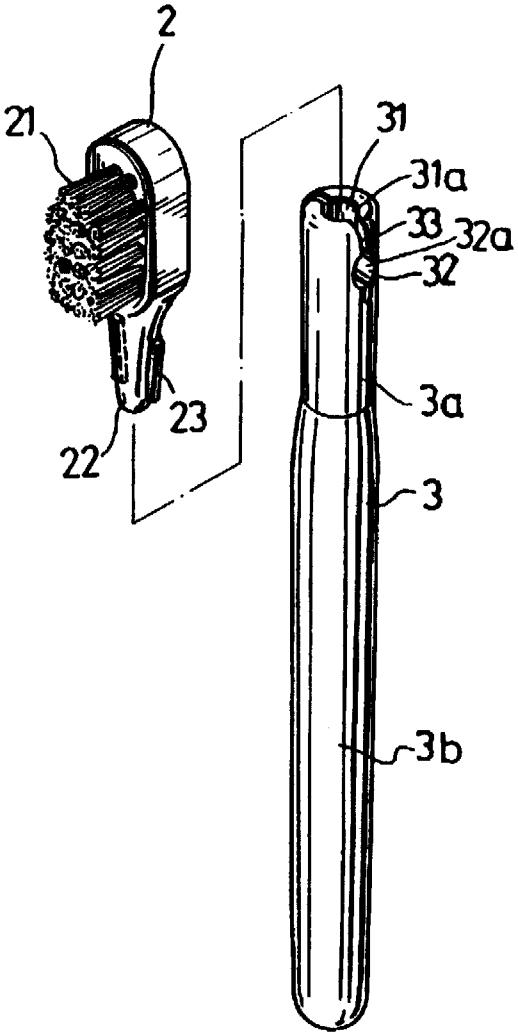
FIG. 3 is an exploded view of the preferred embodiment of a toothbrush of this invention.

Referring to FIGS. 3 and 4, the preferred embodiment of a toothbrush according to this invention is shown to include a bristle head 2 and an elongated handle 3.

As illustrated, the bristle head 2 has a plurality of tufts of bristles 21 for brushing purposes, an elongated shaft 22 extending axially from the bristle head 2, and two engagement ribs 23 formed axially on an external surface of the shaft 22. The shaft 22 tapers gradually toward a distal end thereof and has a circular cross section.

The handle 3 has an upper portion **3*a* and a lower portion 3*b*. The upper portion 3*a* of the handle 3 has an axial hole 31 which forms an opening 31*a* at a top end of the upper portion, a radial hole 32 which extends radially through the upper portion 3*a* and which is communicated with the axial hole 31, the radial hole 32 forming two mouths 32*a* at two diametrically opposite positions of a circumferential wall of the upper portion 3*a*, and two axial slits 33 which extend respectively along the circumferential wall from the opening 31*a* to the mouths 32*a* such that the axial hole 31 is also opened laterally through the axial slits 33**.

Note that the handle 3 is made of a material, such as plastic, which enables snug-fit connection of the shaft 22 in the axial hole 31 or the radial hole 32 when the shaft 22 of the bristle head 2 is inserted via the opening **31*a* or the mouths 32*a*. As best shown in FIG. 4, the shaft 22 and the engagement ribs 23 of the bristle head 2 extend respectively into the axial hole 31 (see FIG. 3) and the axial slits 33** in the handle 3, thereby preventing rotation of the bristle head 2 relative to the handle 3.

Figure 1:
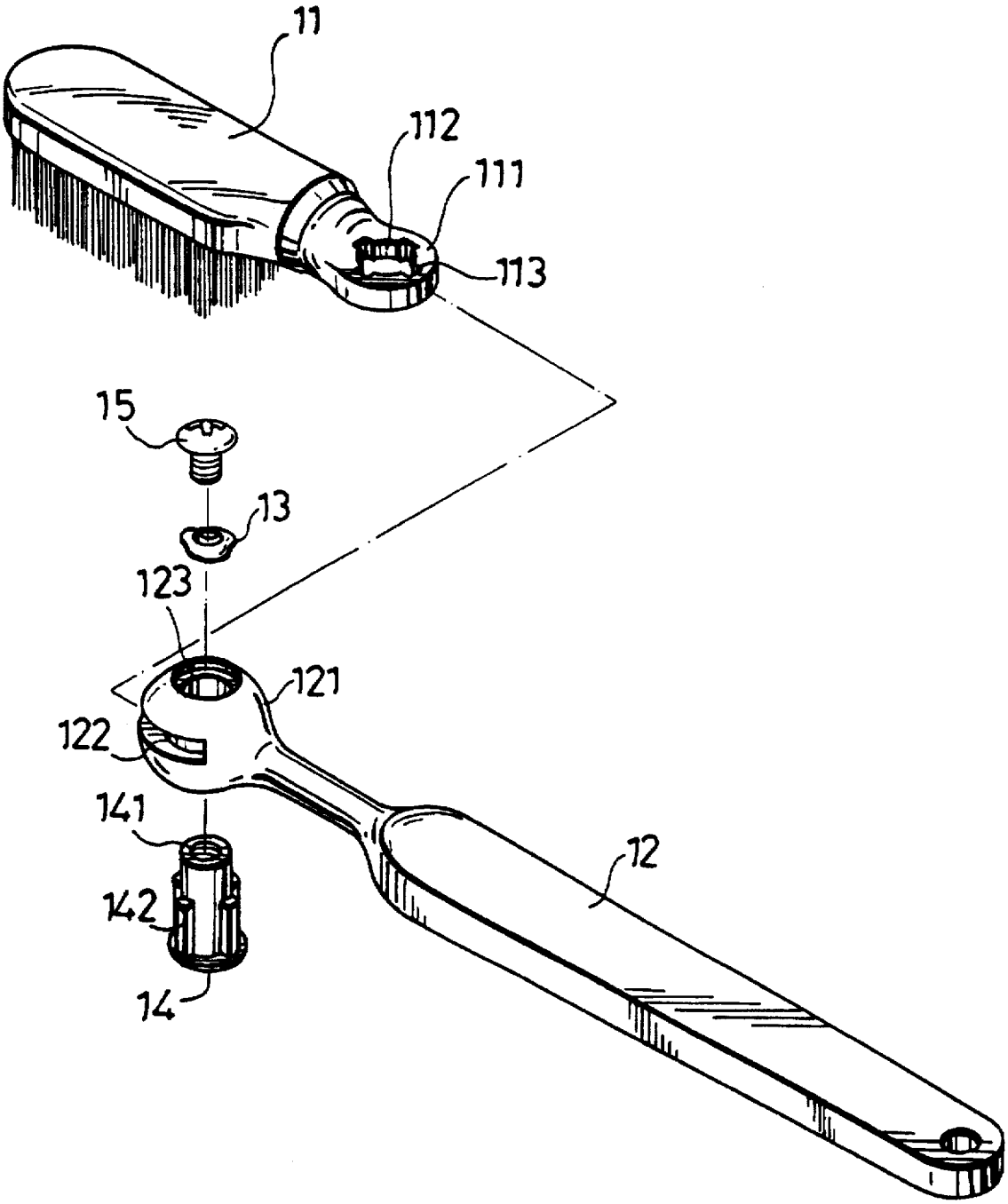
FIG. 1 PRIOR ART
FIG. 1 is an exploded view of a conventional toothbrush.
Figure 2:
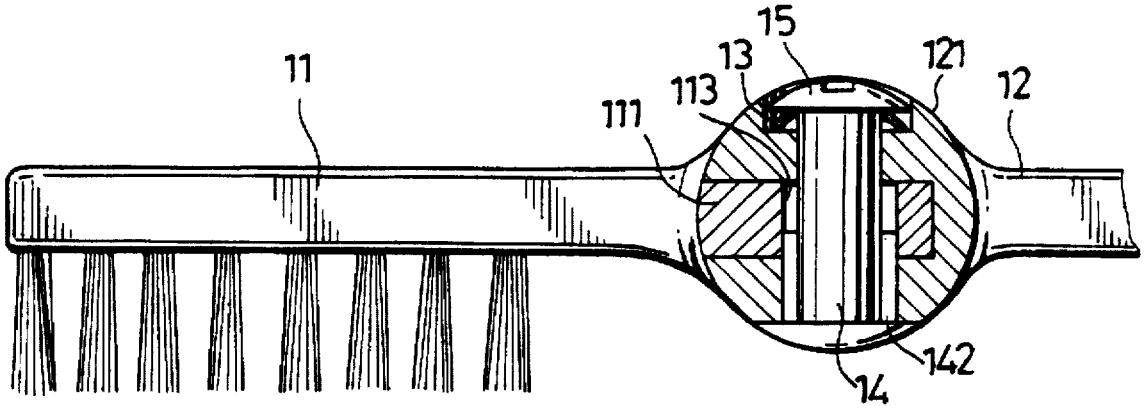
FIG. 2 PRIOR ART
FIG. 2 is a partly sectional side view which illustrates how a bristle head is connected to an elongated handle so as to form the conventional toothbrush.
Figure 5:
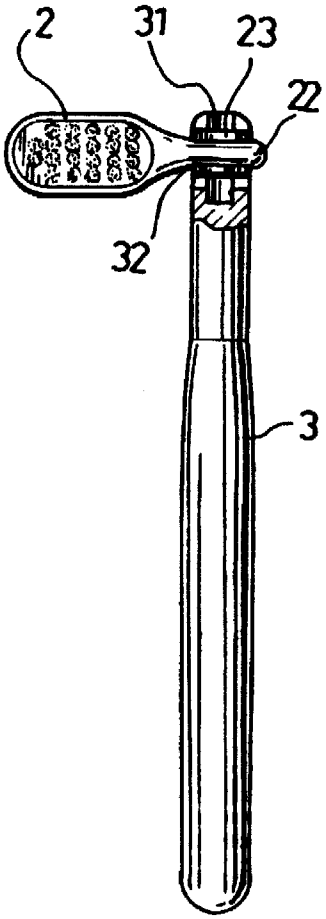
FIG. 5 illustrates how a bristle head is inserted transversely into an elongated handle from the left side so as to form the toothbrush according to this invention.
Figure 6:
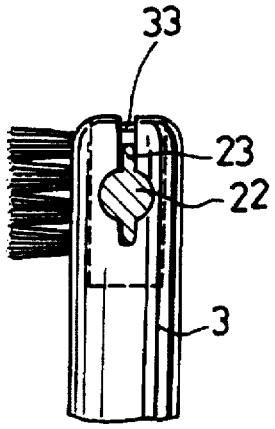
FIG. 6 is an enlarged view which illustrates how the bristle head is inserted into the handle so as to form the toothbrush of this invention.
Figure 7:
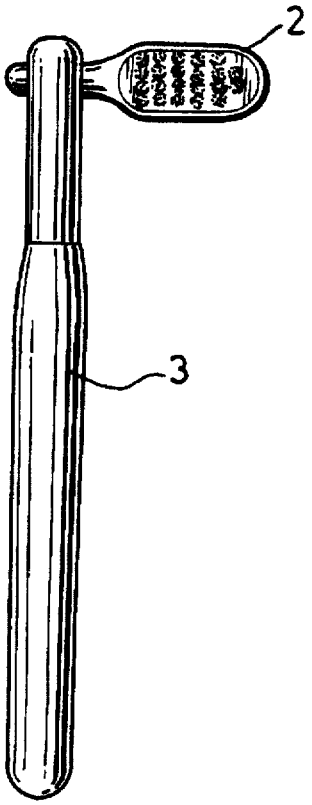
FIG. 7 illustrates how the bristle head is inserted transversely into the elongated handle from the right side so as to form the toothbrush according to this invention.

As illustrated in FIGS. 5, 6, and 7, when desired, the shaft 22 of the bristle head 2 can be inserted into the radial hole 32 in the handle 3 either from the left or right side, wherein the engagement ribs 23 extend respectively into and engage the axial slits 33 in the handle 3.

Figure 8:
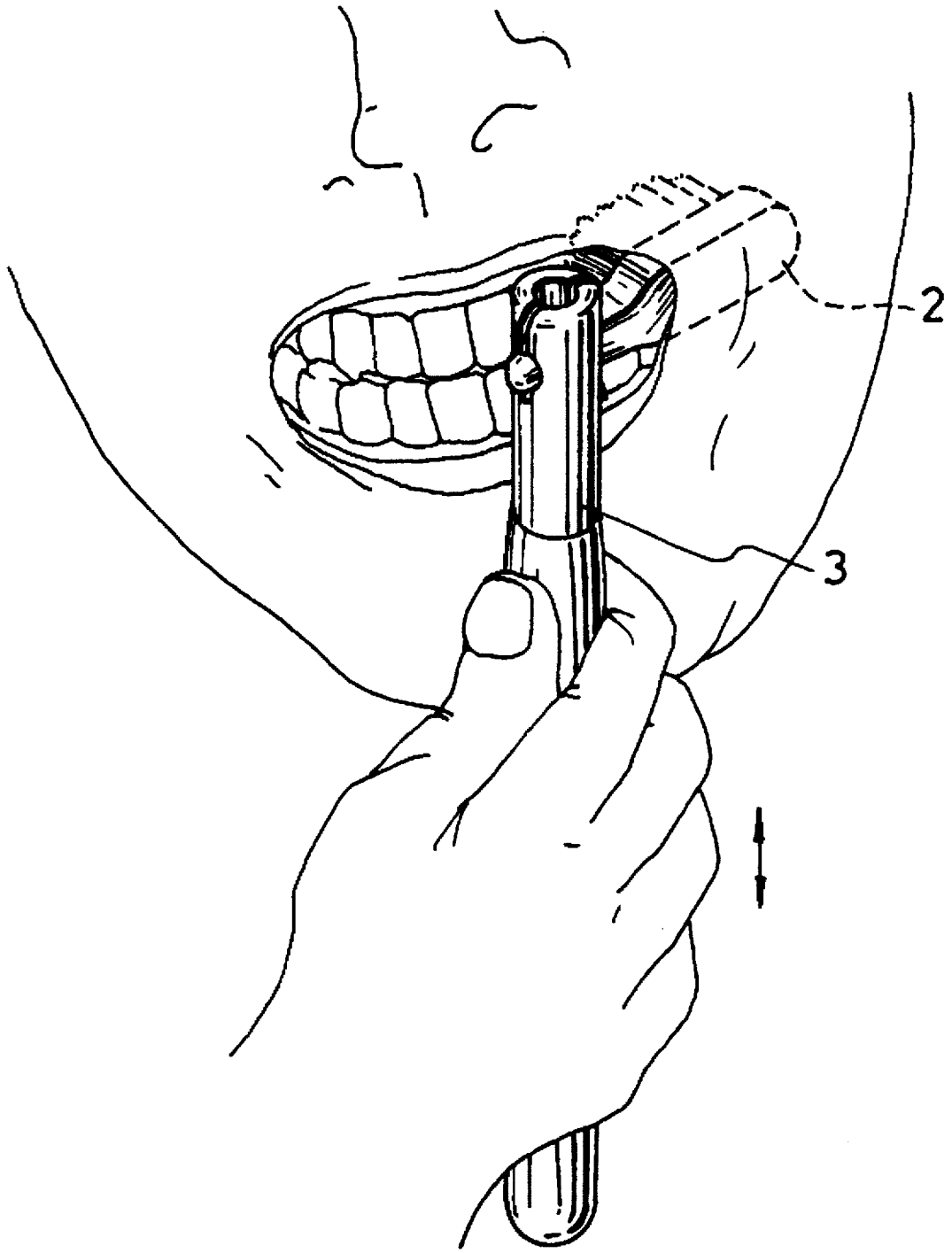
FIG. 8 illustrates the toothbrush of this invention in use.

FIG. 8 illustrates the toothbrush of this invention in use, wherein the bristle head 2 is attached at the radial hole 32 (see FIG. 3) in the handle 3 to permit cleansing of the teeth while the handle 3 is moved reciprocatingly in the vertical direction.

With this invention thus explained, it is apparent that numerous modifications and variations can be made without departing from the scope and spirit of this invention. It is therefore intended that this invention be limited only as indicated in the appended claims.

I claim:

1. A toothbrush comprising:

a bristle head having an elongated shaft which extends therefrom, and an engagement rib formed axially on an external surface of said shaft; and an elongated handle having an upper portion and a lower portion, said upper portion having an axial hole which forms an opening in a top end of said upper portion, a radial hole which extends radially through said upper portion in communication with said axial hole and that forms a mouth at a circumferential wall of said upper portion, and an axial slit extending along said circumferential wall from said opening to said mouth such that said axial hole is also opened laterally through said axial slit;

wherein said elongated handle is made of a material which enables a snug-fit connection of said elongated shaft in one of said axial hole and said radial hole via one of said opening and said mouth when said shaft and said engagement rib on said bristle head are inserted respectively into said axial hole and said axial slit in said handle, or into said radial hole and said axial slit in said handle.

2. The toothbrush as defined in claim 1, wherein said shaft tapers gradually toward a distal end thereof and has a circular cross section.

* * * * *